US011623158B1

(12) United States Patent
Zhao

(10) Patent No.: US 11,623,158 B1
(45) Date of Patent: Apr. 11, 2023

(54) STORAGE-SIZE-ADJUSTABLE PLAY TUNNEL FOR CHILDREN

(71) Applicant: Guanglu Zhao, Fuzhou (CN)

(72) Inventor: Guanglu Zhao, Fuzhou (CN)

(73) Assignee: Guanglu Zhao, Fuzhou (CN)

( * ) Notice: Subject to any disclaimer, the term of this patent is extended or adjusted under 35 U.S.C. 154(b) by 0 days.

(21) Appl. No.: 17/712,142

(22) Filed: Apr. 2, 2022

(30) Foreign Application Priority Data

Oct. 22, 2021 (CN) ..... 202122559712.5

(51) Int. Cl.
*A63H 33/00* (2006.01)

(52) U.S. Cl.
CPC ..... *A63H 33/008* (2013.01)

(58) Field of Classification Search
CPC ..... A63H 33/008; A63H 33/42
USPC ..... 446/227, 478, 487, 488
See application file for complete search history.

(56) References Cited

U.S. PATENT DOCUMENTS 5,618,246 A * 4/1997 Zheng ..... A63B 9/00 D21/826
5,685,076 A * 11/1997 Curley ..... E04H 15/40 29/897.3
6,289,910 B1 * 9/2001 Zheng ..... E04H 15/006 135/125
6,694,994 B1 * 2/2004 Zheng ..... A63H 33/008 135/117
7,662,012 B2 * 2/2010 Wright ..... A63H 37/005 446/61
7,854,688 B2 * 12/2010 Zheng ..... A63B 9/00 190/107
8,021,272 B2 * 9/2011 Zheng ..... A63B 9/00 482/148
8,464,448 B2 * 6/2013 Palmer ..... G06Q 30/0225 40/617
11,213,764 B1 * 1/2022 Li ..... E04H 15/40
2002/0030052 A1 * 3/2002 Joo-Tai ..... D06F 95/002 220/9.2
2003/0022761 A1 * 1/2003 Brereton ..... A63B 9/00 482/35
2006/0141896 A1 * 6/2006 Owens ..... A63H 33/18 446/48
2014/0194031 A1 * 7/2014 Tobias ..... A63H 33/008 446/227
2022/0152519 A1 * 5/2022 Quinn ..... A63H 33/046

* cited by examiner

*Primary Examiner* — Joseph B Baldori
(74) *Attorney, Agent, or Firm* — Zhu Lehnhoff LLP

(57) ABSTRACT

A storage-size-adjustable play tunnel for children includes a supporting frame constituting a tunnel structure, and a cloth cover. End openings at two sides of the tunnel structure communicate each other. The supporting frame is formed by bending a spring steel wire. The spring steel wire is bent to form a plurality of continuous loop parts. Both ends of the spring steel wire are provided with a locking mechanism. By means of the locking mechanism, the two ends of the spring steel wire can integrally slide along the spring steel wire and be fastened onto any positions of the spring steel wire. With sliding of the two ends of the spring steel wire, the supporting frame is adjustable in a radial direction as a whole.

6 Claims, 3 Drawing Sheets

STORAGE-SIZE-ADJUSTABLE PLAY TUNNEL FOR CHILDREN

This application claims the priority of Chinese Patent Application No. 202122559712.5, filed on Oct. 22, 2021, the entire disclosure of which is incorporated herein by reference.

TECHNICAL FIELD

The invention belongs to a play tunnel for children, particularly to a storage-size-adjustable play tunnel for children, and relates to the technical field of toys for children.

BACKGROUND

Play tunnels for children are a type of children's toys most popular in the market in recent years, which is very popular among young parents because it can exercise infants' crawling and exercise capabilities and has a wide range of use scenarios.

With a view to actual application requirements of products of play tunnels for children, in order to ensure stability of tunnel structures, most of existing play tunnels for children use spring steel wires as supporting frames, diameters of molded spring steel wires are fixed, the overall size of the products in a collapsed storage state is large, and requirements for storage space are high, which is inconvenient for daily storage of logistics and warehousing enterprises, and leads to low practicability.

In summary, if a solution for the products of play tunnels for children that can effectively reduce the storage size of the products can be proposed to improve the practicability of the products of play tunnels for children, then it will certainly be able to increase audiences of the products and improve sales volume of the products.

SUMMARY

In view of the above-mentioned defects in the conventional art, the invention is intended to provide a storage-size-adjustable play tunnel for children. Details are as follows.

A storage-size-adjustable play tunnel for children includes a supporting frame that constitutes an overall framework of a tunnel structure and a cloth cover that covers the periphery of the supporting frame and is used to form an outer wall of the tunnel structure. End openings at two sides of the tunnel structure communicate each other. The supporting frame is formed by bending a spring steel wire. The spring steel wire is bent to form a plurality of continuous loop parts. Both ends of the spring steel wire are provided with a locking mechanism. By means of the locking mechanism, the two ends of the spring steel wire can integrally slide along the spring steel wire and be fastened onto any positions of the spring steel wire. With sliding of the two ends of the spring steel wire, the supporting frame is adjustable in a radial direction as a whole.

Preferably, the locking mechanism includes a first locking member and a second locking member, the first locking member is fixedly connected to one end of the spring steel wire, the second locking member is fixedly connected to the other end of the spring steel wire, and the first locking member and the second locking member are consistent in shape and specification.

Preferably, a fixed connection manner between the first locking member and the spring steel wire is the same as that between the second locking member and the spring steel wire.

Preferably, each of the first locking member and the second locking member is composed of a plastic buckle and a fastener, the fastener is fixedly connected to the bottom of the plastic buckle, the overall fastener is of a U-shaped structure that can produce an elastic deformation, an outer wall of the fastener is abutted against a retainer, and an extension portion is arranged on an outer side of a tail end of the fastener.

Preferably, the fixed connection manner refers to buckle connection, or melt connection, or integral molding.

Preferably, the cloth cover is arranged in a length direction of the spring steel wire; the cloth cover is made of a multi-layer composite material, and the cloth cover sequentially includes an outer protective layer, a middle elastic layer, and an inner slide layer from outside to inside.

Preferably, an anti-slip structure is arranged on an inner surface of the inner slide layer, the anti-slip structure referring to dotted protrusions or a stripped texture.

Preferably, a material of the outer protective layer is fireproof cloth, the middle elastic layer is elastic fabric, and the inner slide layer is fibre cloth.

The invention mainly has the advantages in the following aspects.

According to the storage-size-adjustable play tunnel for children provided in the invention, with the arrangement of the locking mechanism, under full use of flexibility of the spring steel wire, the supporting frame of the entire tunnel becomes adjustable in the radial direction, a user may perform a corresponding collapsing operation to reduce a diameter of the supporting frame to further reduce an overall size of a product in a storage state, thereby facilitating daily storage for ordinary family and improving overall practicability of the product.

Moreover, the overall structure of the invention is clear, and a positional relationship and a connection relationship between hardwares are clear. In the solution, each part is made of a material comment in the market. Each manufacturer may obtain the technical solution of the invention by modifying and upgrading the existing product of play tunnel for children according to actual application requirements. The overall implementation cost of the solution is low, which is conducive to promotion and use in large scale.

The specific embodiments of the invention will be described in further detail below with reference to the accompanying drawings, so as to make the technical solution of the invention easier to understand and master.

BRIEF DESCRIPTION OF THE DRAWINGS

The accompanying drawings constituting a part of this application are used to provide a further understanding of this application, so that other features, objectives, and advantages of this application become more apparent. The drawings and descriptions of the exemplary embodiments of this application are intended to explain this application, and do not constitute an improper limitation on this application. The accompanying drawings are as follows.

Figure 1:
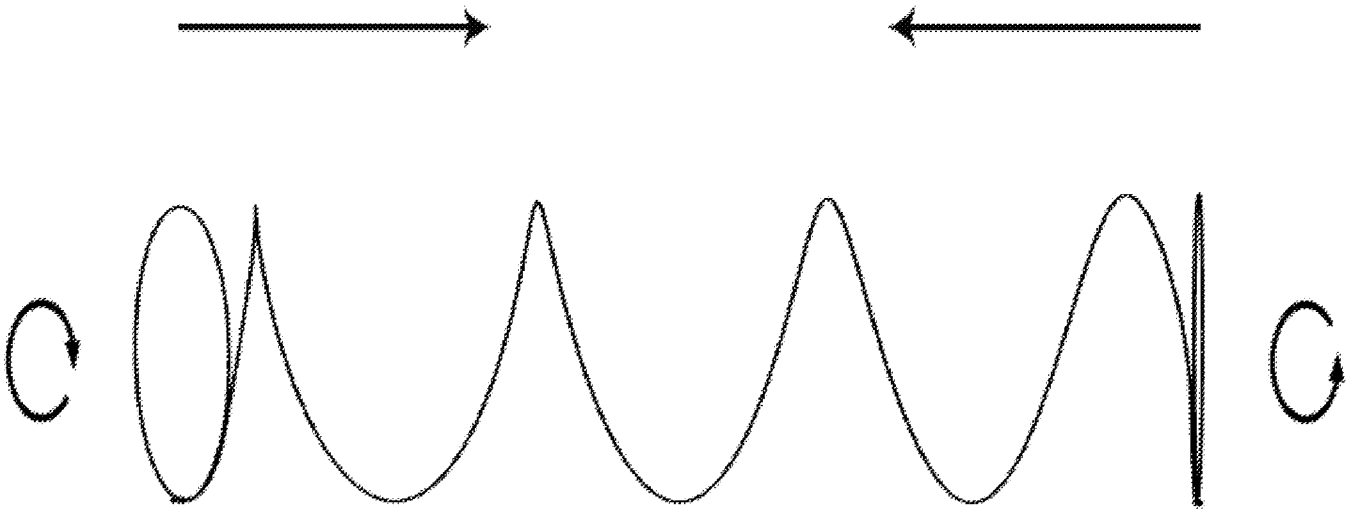
FIG. 1 is a schematic structural diagram of an overall framework of a tunnel structure in an embodiment of the invention.

In the drawings: 1, spring steel wire; 2, first locking member; 3, second locking member; 4, plastic buckle; 5, fastener; 6, retainer; and 7, extension portion.

DETAILED DESCRIPTION OF THE EMBODIMENTS

Disclosed is a storage-size-adjustable play tunnel for children. The specific solution is as follows.

A storage-size-adjustable play tunnel for children includes a supporting frame that constitutes an overall framework of a tunnel structure and a cloth cover that covers the periphery of the supporting frame and is used to form an outer wall of the tunnel structure (not shown in the figures). The structure of the overall framework of the tunnel structure is as shown in FIG. 1. End openings at two sides of the tunnel structure communicate each other.

Figure 2:
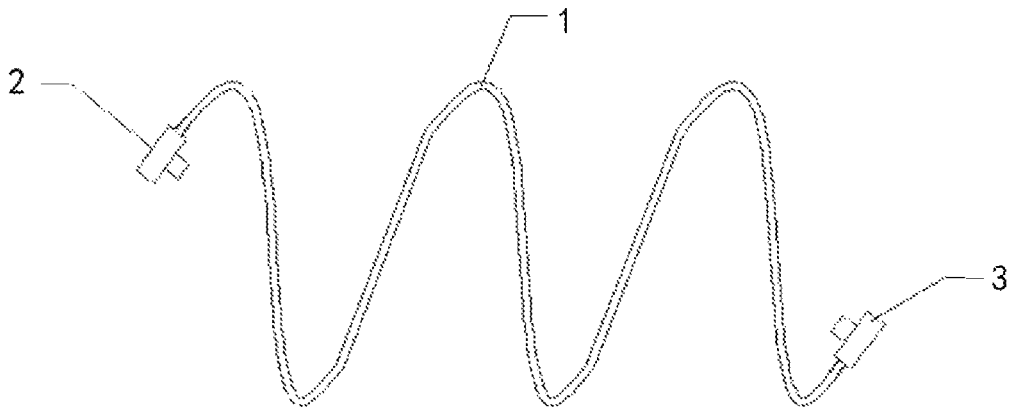
FIG. 2 is a schematic structural diagram of a spring steel wire in an embodiment of the invention.

As shown in FIG. 2, the supporting frame is formed by bending a spring steel wire 1, the spring steel wire 1 is bent to form a plurality of continuous loop parts, both ends of the spring steel wire 1 are provided with a locking mechanism, by means of the locking mechanisms, two ends of the spring steel wire 1 can integrally slide along the spring steel wire 1 and be fastened onto any positions of the spring steel wire 1, and with sliding of the two ends of the spring steel wire 1, the supporting frame is adjustable in a radial direction as a whole.

Figure 3:
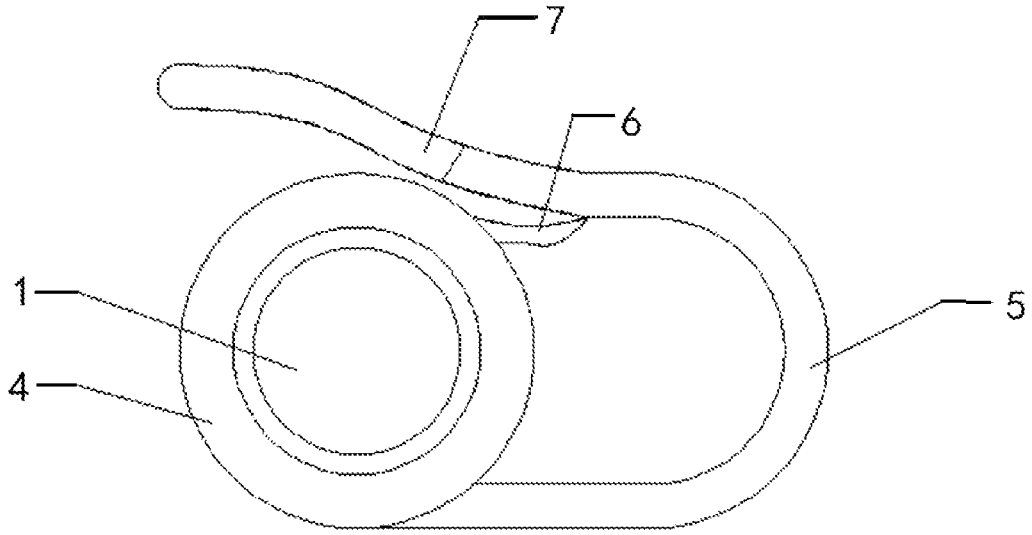
FIG. 3 is a schematic structural diagram of a locking mechanism in an embodiment of the invention.

As shown in FIG. 3, the locking mechanism includes a first locking member 2 and a second locking member 3, the first locking member 2 is fixedly connected to one end of the spring steel wire 1, the second locking member 3 is fixedly connected to the other end of the spring steel wire 1, and the first locking member 2 and the second locking member 3 are consistent in shape and specification. A fixed connection manner between the first locking member 2 and the spring steel wire 1 is the same as that between the second locking member 3 and the spring steel wire.

Each of the first locking member 2 and the second locking member 3 is composed of a plastic buckle 4 and a fastener 5, the fastener 5 is fixedly connected to the bottom of the plastic buckle 4, the overall fastener 5 is of a U-shaped structure that can produce an elastic deformation, an outer wall of the fastener 5 is abutted against a retainer 6, and an extension portion 7 is arranged on an outer side of a tail end of the fastener 5.

The extension portion 7 and the plastic buckle 4 form an elastic structure through the fastener 5. The extension portion 7 can press the fastener 5 to the outside to separate the fastener 5 from the retainer 6. Then, the spring steel wire 1 can be clamped to the inside of the fastener 5. After an external force applied to the extension portion 7 is removed, the fastener 5 will be abutted against the retainer 6 under the action of its own elastic force.

The fixed connection manner refers to buckle connection, or melt connection, or integral molding. In this embodiment, the fixed connection manner refers to the melt connection.

The cloth cover is arranged in a length direction of the spring steel wire 1; the cloth cover is made of a multi-layer composite material, and the cloth cover sequentially includes an outer protective layer, a middle elastic layer, and an inner slide layer from outside to inside.

In order to avoid injuries to infants due to accidents during use of the product, an inner surface of the inner slide layer is provided with an anti-slip structure for increasing a friction force. The anti-slip structure may refer to dotted protrusions or a stripped texture. In this embodiment, the anti-slip structurer refers to the stripped texture; a material of the outer protective layer is fireproof cloth, the middle elastic layer is elastic fabric, and the inner slide layer is Kevlar fabric.

Figure 4:
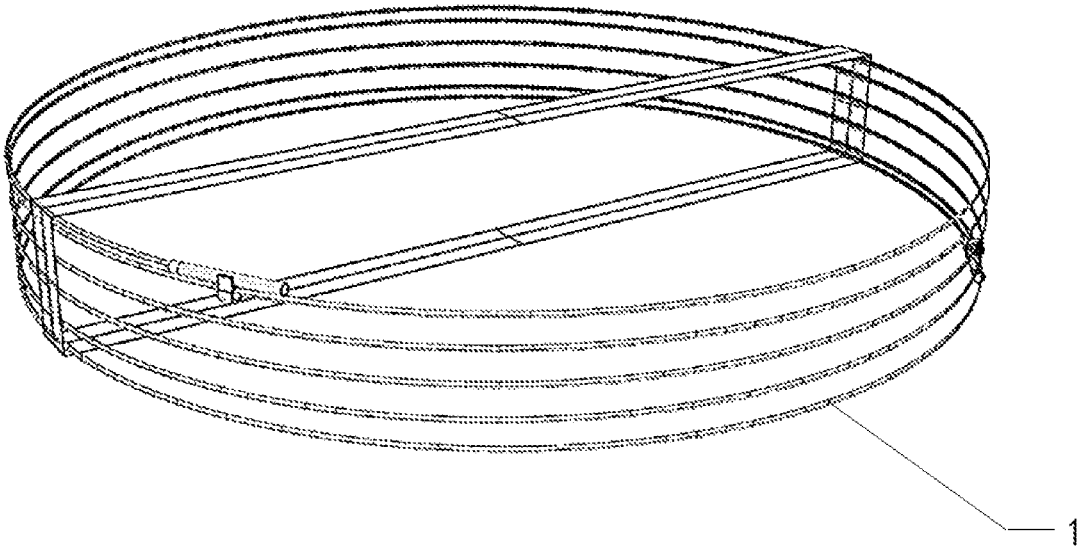
FIG. 4 is a schematic structural diagram showing a storage state of a play tunnel for children in an embodiment of the invention.

In a use state of the product of the invention, a user pushes the fastener 5 to the outside through the extension portion 7 to separate the fastener 5 from the retainer 6, and then, can clamp the spring steel wire 1 to the inside of the fastener 5. By pressing the spring steel wire 1 into the plastic buckle 4 by one person at one end of the spring steel wire 1, a diameter of the spring steel wire 1 is reduced. After the diameter is determined, the external force applied onto the extension portion 7 is removed, the fastener 5 will be abutted against the retainer 6 under the action of its own elastic force. Then, the other side of the spring steel wire 1 that is looped is bound with a tie. Similarly, another person presses the spring steel wire 1 into the plastic buckle 4 at the other end of the spring steel wire 1, and fasten it, and then holds the two ends of the spring steel wire 1 to rotate and collapse until diameters of all the effective loops of the spring steel wire 1 are reduced. The cloth cover on the periphery of the spring steel wire 1 will also be collapsed together with the spring steel wire 1, and a final storage state is as shown in FIG. 4.

In summary, according to the storage-size-adjustable play tunnel for children provided in the invention, with the arrangement of the locking mechanism, under full use of flexibility of the spring steel wire, the supporting frame of the entire tunnel becomes adjustable in the radial direction, the user may perform a corresponding collapsing operation to reduce a diameter of the supporting frame to further reduce an overall size of a product in a storage stage, thereby facilitating daily storage for ordinary family and improving overall practicability of the product.

Moreover, the overall structure of the invention is clear, and a positional relationship and a connection relationship between hardwares are clear. In the solution, each part is made of a material comment in the market. Each manufacturer may obtain the technical solution of the invention by modifying and upgrading the existing product of play tunnel for children according to actual application requirements. The overall implementation cost of the solution is low, which is conducive to promotion and use in large scale.

It will be apparent to those skilled in the art that the invention is not limited to the details of the foregoing exemplary embodiments, but that the invention may be embodied in other specific forms without departing from the spirit and essential features of the invention. Therefore, the embodiments are to be regarded in all respects as exemplary and not restrictive, the scope of the invention is defined by the appended claims rather than the above description, and therefore all changes that fall within the meaning and range of equivalents of the claims are intended to be embraced in the invention.

Finally, it should be appreciated that although this specification is described in terms of implementation modes, not every implementation mode only includes an independent technical solution, this description manner in the specification is only for the sake of clarity, those skilled in the art should take the specification as a whole, and the technical solution in each embodiment can also be appropriately combined to form other implementation modes that can be understood by those skilled in the art.

What is claimed is:

1. A storage-size-adjustable play tunnel for children, comprising a supporting frame that constitutes an overall framework of a tunnel structure and a cloth cover that covers the periphery of the supporting frame and is used to form an outer wall of the tunnel structure, end openings at two sides of the tunnel structure communicating each other; wherein the supporting frame is formed by bending a spring steel wire (1), the spring steel wire (1) is bent to form a plurality of continuous loop parts, both ends of the spring steel wire (1) are provided with a locking mechanism, by means of the locking mechanisms, two ends of the spring steel wire (1) can integrally slide along the spring steel wire (1) and be fastened onto any positions of the spring steel wire (1), and with sliding of the two ends of the spring steel wire (1), the supporting frame is adjustable in a radial direction as a whole, wherein the locking mechanism comprises a first locking member (2) and a second locking member (3), wherein each of the first locking member (2) and the second locking member (3) is composed of a plastic buckle (4) and a fastener (5), the fastener (5) is fixedly connected to the bottom of the plastic buckle (4), the fastener (5) is of a U-shaped structure that can produce an elastic deformation, the fastener (5) is abutted against a retainer (6), and an extension portion (7) is arranged on an outer side of a tail end of the fastener (5).

2. The storage-size-adjustable play tunnel for children as claimed in claim 1, wherein the first locking member (2) is fixedly connected to one end of the spring steel wire (1), the second locking member (3) is fixedly connected to the other end of the spring steel wire (1), and the first locking member (2) and the second locking member (3) are consistent in shape and specification.

3. The storage-size-adjustable play tunnel for children as claimed in claim 2, wherein a fixed connection manner between the first locking member (2) and the spring steel wire (1) is the same as that between the second locking member (3) and the spring steel wire.

4. The storage-size-adjustable play tunnel for children as claimed in claim 3, wherein the fixed connection manner refers to snap fit or melt connection or integral molding.

5. The storage-size-adjustable play tunnel for children as claimed in claim 1, wherein the fixed connection manner refers to snap fit or melt connection or integral molding.

6. The storage-size-adjustable play tunnel for children as claimed in claim 1, wherein the extension portion can be pressed to separate the fastener from the retainer and the elasticity of the fastener allows the fastener to abut the retainer when the extension portion is not pressed.

* * * * *